United States Patent [19]

Welschlau et al.

[11] Patent Number: 4,988,051

[45] Date of Patent: Jan. 29, 1991

[54] METHOD OF WINDING CONTINUOUSLY SUPPLIED MATERIAL ON SEVERAL CORES AND DOUBLE BACKING-ROLLER WINDER

[75] Inventors: Udo Welschlau; Uwe Melching, both of Northeim, Fed. Rep. of Germany

[73] Assignee: Thimm KG, Northeim, Fed. Rep. of Germany

[21] Appl. No.: 214,955

[22] Filed: Jul. 5, 1988

[30] Foreign Application Priority Data

Jul. 18, 1987 [DE] Fed. Rep. of Germany ..... 3723827

[51] Int. Cl.[5] ..... B65H 19/28

[52] U.S. Cl. ..... 242/56 R; 242/66

[58] Field of Search ..... 242/56 R, 66

[56] References Cited

U.S. PATENT DOCUMENTS 2,915,255 12/1959 Phelps ..... 242/56 R
3,062,465 11/1962 Hunter ..... 242/56 R
3,345,010 10/1967 Egan ..... 242/66
3,817,467 6/1974 Dambroth ..... 242/66 X
4,606,381 8/1986 Suwa ..... 242/66 X
4,609,162 9/1986 Kataoka ..... 242/56 R

FOREIGN PATENT DOCUMENTS 3143281 5/1983 Fed. Rep. of Germany .... 242/56 R

*Primary Examiner*—Katherine Matecki
*Attorney, Agent, or Firm*—Max Fogiel

[57] ABSTRACT

A method of winding continuously supplied material onto several core tubes, especially on printing presses, has a double backing-roller winder that has two backing rollers and a bed wherein the material is wound into a reel while resting on a tensioning roller. The material (11) is initially wound on a core tube (7) that rests against the two backing rollers (3 and 4) in the double backing-roller winder until the reel is heavy enough to weigh down against the supporting roller (21) in a Pope winder (2). A pivoting mechanism (23) lifts the reel off the bed (14) of the double backing-roller winder, over the second backing roller (4), and against the supporting roller in the Pope winder. The reel is then wound in that position until it attains its prescribed final diameter.

15 Claims, 5 Drawing Sheets

Figure 1:
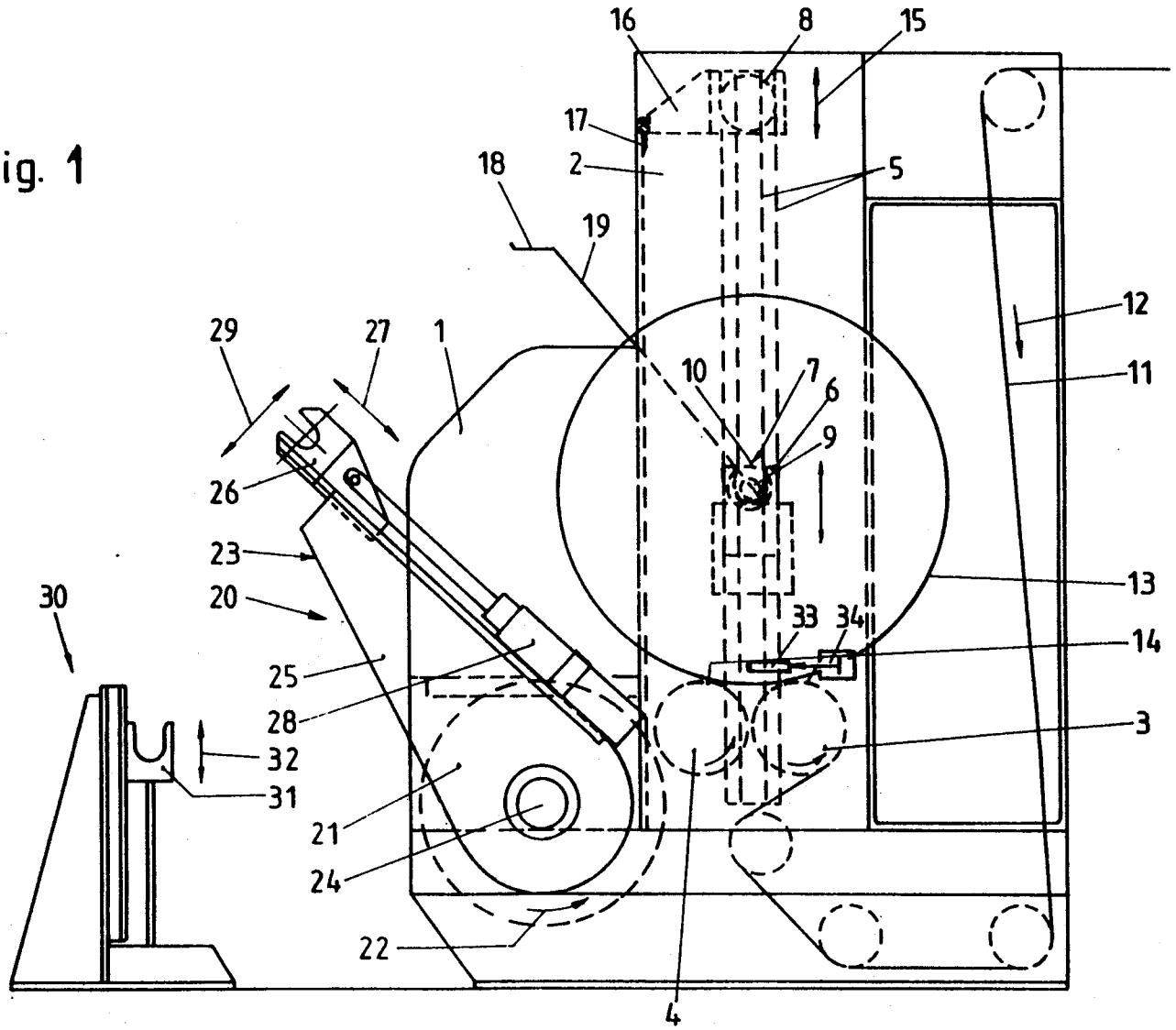

METHOD OF WINDING CONTINUOUSLY SUPPLIED MATERIAL ON SEVERAL CORES AND DOUBLE BACKING-ROLLER WINDER

The invention concerns a method of winding continuously supplied material onto several core tubes, especially on printing presses, with a double backing-roller winder that has two backing rollers and a bed wherein the material is wound into a reel while resting on a tensioning roller. The invention also concerns a double backing-roller winder for winding continuously supplied material on several core tubes, with two powered backing rollers that constitute a bed for each reel, which consists of a core tube and of the material being wound, with a tensioning roller that extends vertically over the bed, and with a mechanism for supplying the core tubes, a mechanism for removing the reels, and a cutting mechanism for cutting off the material being wound. The invention is in particular employed at the end of printing presses that must operate in precise register and depend on straight-edged winding.

A method of the aforesaid type and an associated double backing-roller winder are known from U.S. Pat. No. 2,989,262. Two horizontally adjacent powered backing rollers constitute a bed for a core tube that is subject to vertical force from a tensioning roller in the bed. The web-like, continuously, uninterruptedly, that is, supplied material is wound on one core tube after another, finally resulting in corresponding reels. At one end of the double backing-roller winder is a mechanism for supplying the core tube and at the other is a mechanism for removing the finished reels. Mounted in the nip between the two backing rollers in such a way that it can move is a knife-like mechanism that can cut through the web of material from the bottom up, establishing the end of the material on one reel and the beginning of the material on the subsequent core tube. Since the cutting mechanism occupies a certain amount of space in the nip between the two backing rollers, the backing rollers must be positioned with their axes farther apart than would be dictated by their diameters alone. This requisite in turn dictates that the core tube must have a minimum diameter, and small tubes cannot be employed. A double backing-roller winder of this type, however, does support the reel on the backing rollers effectively. The tensioning roller also makes it possible to maintain an almost constant tension on the web, even while the diameter of the reel is still short, because the tensioning roller can be individually activated and deactivated. A double backing-roller winder of this type is also outstanding in that it allows the web of material to be wound with its edges straight. It is, however, fairly difficult to remove a full reel and replace it with a fresh core tube. Still, its capacity for maintaining a constant stress on the web makes it possible to employ a double backing-roller winder of this type not only in such simple applications as all-over coloring or coating of the web but also with printing presses.

German OS No. 3 216 399 also discloses a double backing-roller winder wherein the two backing rollers are fairly far apart. This is necessary because the mechanism that supplies the core tubes rises up through the nip between the two backing rollers when it initiates the winding procedure on a fresh core. It is also possible to position a third backing roller downstream of the first two and allow the core-tube supply mechanism to rise through the nip between the second and third backing roller. Here as well, however, the limited geometry dictates core tubes with a minimum diameter. There are also problems in winding the material when the reel begins to increase in diameter and in utilizing the tensioning roller at that point.

Machines called Pope winders are also known. They consist essentially of a powered supporting roller and of a pivoting mechanism with a component that accommodates a bearing for the core tube. The growing reel accordingly does not rest on two backing rollers as in a double backing-roller winder, but against the supporting roller, and generally with only some of its weight, during the winding procedure. The pivoting mechanism pivots around an axis adjacent to that of the supporting roller, and its function is to lift a finished reel out of the device and remove it. Pope winders are essentially employed in the paper industry in the manufacture and further processing of paper, to color, coat, calender, or otherwise treat it, when, that is, precise registration is not important. The major advantage of this type of winder is the ease with which a full reel can be replaced with a fresh core tube without having to interrupt the supply of material. A number of serious drawbacks, however, occur in conjunction with printing presses, which must operate with precise registration. Thus, it is difficult to control the tension on the web. The reel also rests and is forced against the supporting roller in a way that is unsatisfactory and impossible to control, especially when the core tube has a short diameter, somewhere on the order of 100 mm, and the web is wide, on the order of 2.5 m or more for example. The tendency of the tube to buckle is also significant in webs that wide, and enough web-tension irregularities can also occur upstream in the printing press, to ensure registration errors at that point while the reel is being wound, especially when the diameter is still short. Since it is also often difficult to prevent wrinkling at the beginning of the reel, core tubes that have longer diameters than those that can be employed in a double backing-roller winder must in principle be employed. The tension on the web tends to fluctuate at the beginning of the winding procedure and is not as easy to control until the diameter attains a certain length.

Thus, in the technology of winding endless strips onto reels, there are two types of arrangements through which the winding is made possible. One method uses the commonly-referred to double backing-roller winder, and the other method uses the Pope roller. A double backing-roller winder is an arrangement in which the reel lies on two backing rollers during the winding procedure. Thus, the reel lies in a nest between both backing rollers. A Pope roller, on the other hand, is an arrangement in which the reel with the material to be wound thereon, lies only on a single supporting roller. An example of a double backing-roller is to be found in U.S. Pat. Nos. 2,989,262 and 3,345,010. The principle of a Pope roller is described in U.S. Pat. No. 2,915,255.

The object of the present invention is, on the basis of a conventional backing-roller winder with backing rollers that are close to each other, to provide a method and a double backing-roller winder that will make it possible to maintain extensively constant tension on the web, to operate automatically, without, that is, interrupting the supply of material, to replace the reels without any problems, and to wind the material with its edges straight.

This object is attained in accordance with the invention in a method of the aforesaid type in that the material is initially wound on a core tube that rests against the two backing rollers in the double backing-roller winder until the reel is heavy enough to weigh down against the supporting roller in a Pope winder, in that a pivoting mechanism lifts the reel off the bed of the double backing-roller winder, over the second backing roller, and against the supporting roller in the Pope winder, and in that the reel is then wound in that position until it attains its prescribed final diameter. This method combines the advantages of both a double backing-roller winder and a Pope winder without the drawbacks of either machine. Thus, the winding procedure begins against the backing rollers in the double backing-roller winder and subject to the tensioning roller, keeping the reel tight, which is a prerequisite for preventing telescoping as the winding continues, from the very beginning. Furthermore, the tension on the web will be constant from the very beginning, with the tensioning roller also making it possible to apply tension at one or both sides individually as necessary. Overall contact will result from the two contact areas of both backing rollers. Only once the reel attains an appropriate weight will the tensioning roller release its pressure and the reel be transferred to the Pope winder, where it will be wound to its prescribed final diameter. At this point, however, the reel will be heavy enough to rest against the supporting roller in the Pope winder in such a way as to ensure constant web tension, a tight core, and precise registration. Another and particular advantage, however, will simultaneously be attained in that the double backing-roller winder will be free again for quite a while, making it possible to prepare and position a fresh core tube without any problems and to make it available for winding while the finished reel is being replaced by the flying-exchange method.

Once the reel has been accepted by the Pope winder, a fresh core tube can be prepared for winding and, once the previously wound reel has attained its prescribed final diameter, can be lowered into the bed created by the backing rollers in the double backing-roller winder, with the web of material being wound simultaneously being separated between the second backing roller and the supporting roller. The geometry will accordingly be unambiguous and there will be enough time to replace the reel without any problems.

The pivoting mechanism in the Pope winder can remove the finished reel, lift a fresh core tube into an intermediate station in the double backing-roller winder, and lift the partly wound reel on the backing rollers onto the supporting roller in the Pope winder. The pivoting process carried out by the mechanism in the Pope winder is accordingly exploited throughout each phase of the method to carry out several functions. A separate conveyor and controls are accordingly unnecessary.

The web of material being wound can be separated during the top-to-bottom motion. The direction in which a fresh core tube is dropped onto the bed created by the two backing rollers and the direction in which the knife-like cutting mechanism moves will accordingly correspond. This makes it possible to synchronize the two motions very precisely, resulting in the advantage that the backing rollers in the double backing-roller winder can be relatively close to each other, which entails the further advantage that core tubes with relatively short diameters can be employed, even with wide webs. Finally, the supporting roller in the Pope winder can also be very near the second backing roller in the double backing-roller winder, making the overall device short and allowing the reel to be transferred very rapidly and over a short path from the double backing-roller winder to the Pope winder.

A double backing-roller winder of the aforesaid type is characterized in accordance with the invention by a Pope winder downstream of its two backing rollers with a supporting roller and a pivoting mechanism, in that the supporting roller has a longer diameter than the backing rollers, and in that the pivoting mechanism pivots around the axis of the supporting roller. The resulting device is a combination double backing-roller winder and Pope winder, whereby the backing rollers in the double backing-roller winder and the supporting roller can be positioned directly adjacent and in sequence. The diameter of the backing rollers in the double backing-roller winder can in a practical way be comparatively short and the diameter of the supporting roller independently comparatively large. The backing rollers and the supporting roller can nevertheless be directly next to each other. This design also makes it possible to make the contact areas and surface pressure extensive enough in the contact surfaces to prevent irregular web tension. The device is accordingly especially appropriate for printing presses, which must operate with precise registration. While the reels are still short in diameter, the advantages of a double backing-roller winder—satisfactory initial winding tightness and constant web tension—will be completely exploited, whereas, once the reels attain a long diameter, their weight will be adequate for further winding on a Pope winder. The edges of the reel will accordingly be straight and the web tension essentially constant during all phases of winding.

The pivoting mechanism can have two arms with sliding components mounted on them to accommodate the core tube and can pivot along with the core-tube accommodating components either into the space above the backing rollers or beyond the winding position in the Pope winder as far as a mechanism for intercepting and removing the finished reels. The pivoting mechanism can accordingly carry out many functions that have previously required several separate mechanism.

The core tube can be mounted in axially stationary bearings above the backing rollers and/or in the vicinity of the Pope winder. This measure also helps to ensure straight-edged winding.

The pivoting mechanism in the Pope winder can also function as a mechanism for supplying fresh core tubes and for removing the finished reels. It will of course be evident that the pivoting mechanism will have to be able to pivot around a more obtuse angle and that appropriate controls will be necessary. Since, however, the core-tube accommodating components in the pivoting arms can at any rate move radially, the additional expenditure will be slight.

There can be an intermediate station for the pivoting mechanism to deposit ready-to-wind core tubes in and whence they arrive into the bed created by the two backing rollers. Although it is of course also possible to position ready-to-wind core tubes in other ways, the proposed embodiment allows the reel-changing process to be completely automated.

Vertical guides for claws that accommodate a core tube and for bearings that a tensioning roller is mounted in can be located in the space above the backing rollers and a cutting mechanism for separating the material being wound can be attached to the tensioning-roller bearings between the second backing roller and the supporting roller. This measure directly synchronizes the motion of the tensioning roller with that of the cutting mechanism, so that both procedures can be carried out together without any problem.

Figure 7:
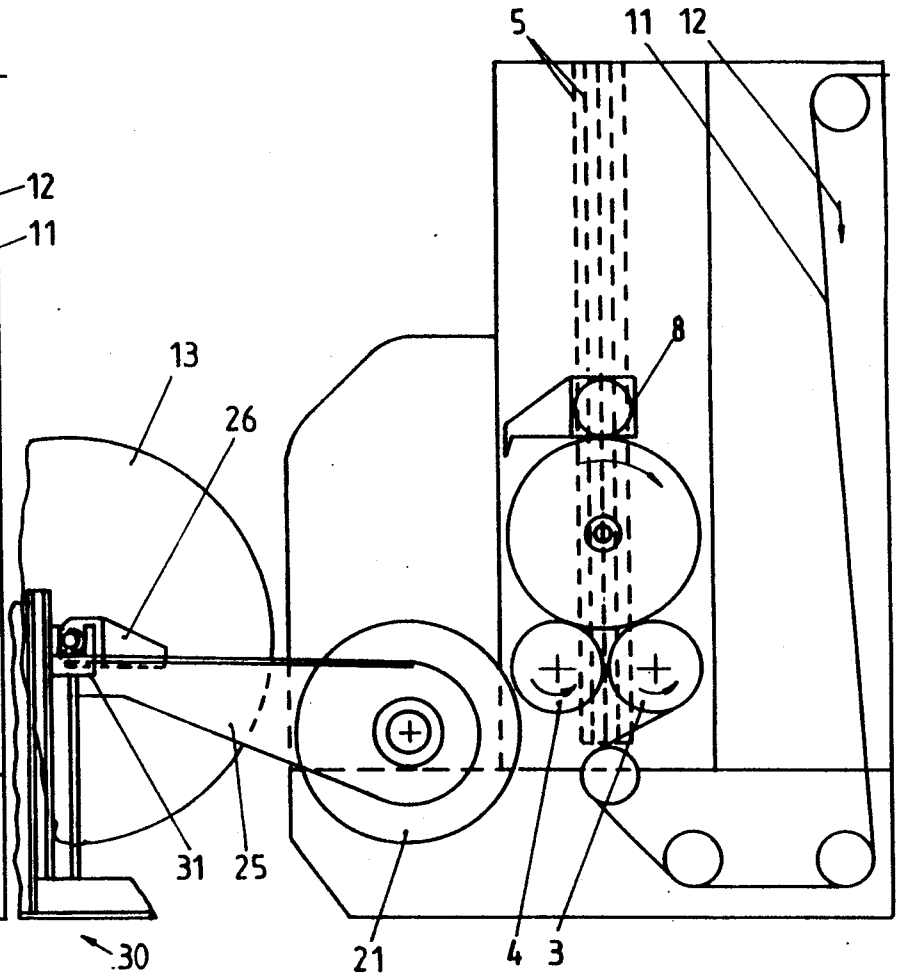
Figure 9:
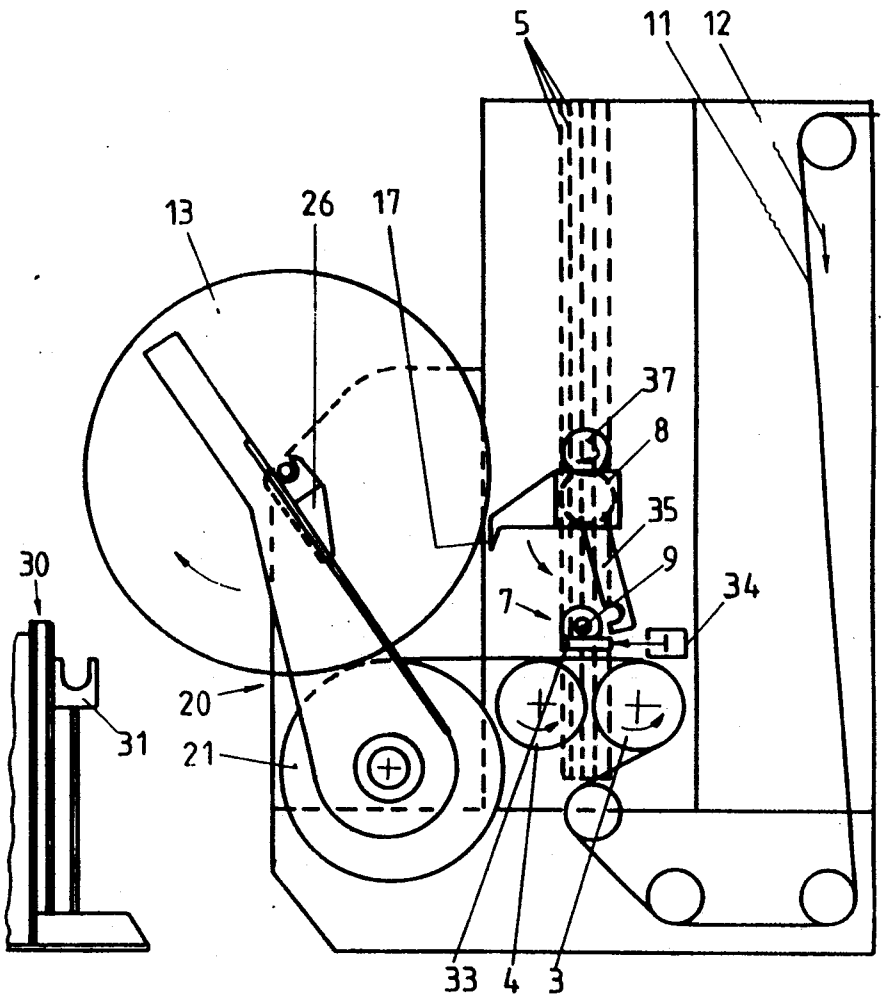
Figure 8:
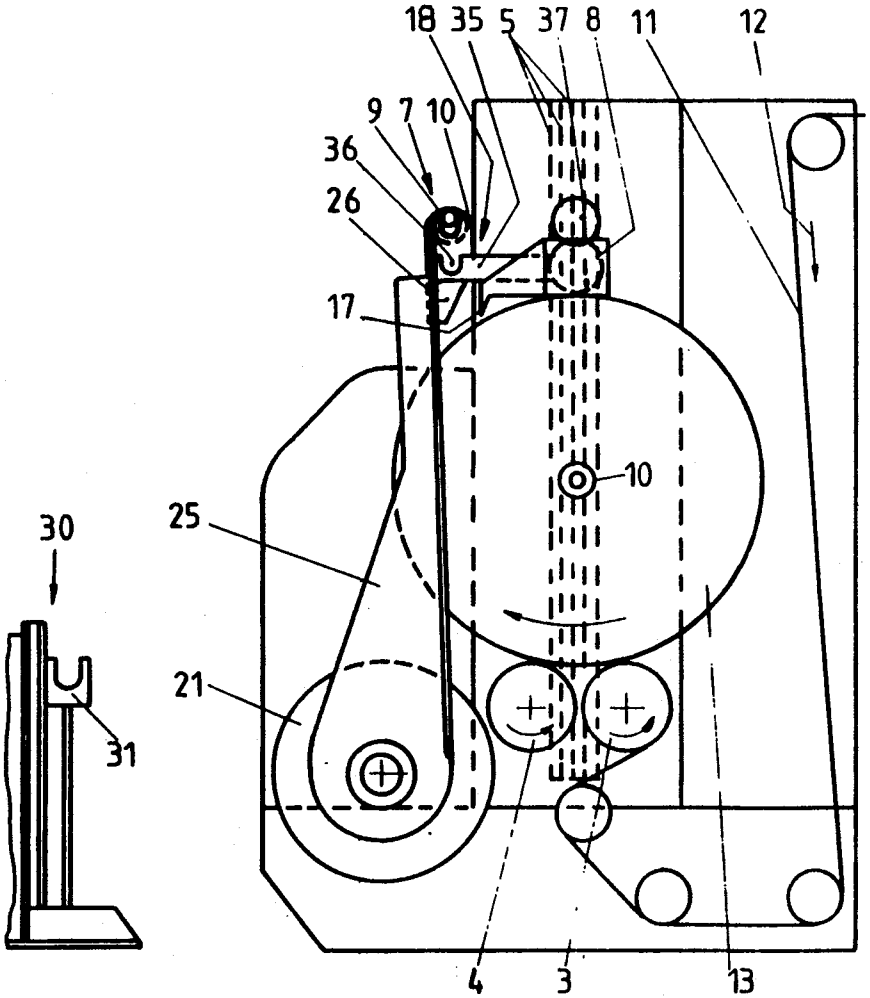

A preferred embodiment of the invention will now be specified with reference to the drawings, wherein FIG. 1 is a schematic side view of the essential components of a combination double backing-roller winder and Pope winder, FIGS. 2 through 7 illustrate a complete cycle of the operations involved in winding and replacing a reel along with the intermediate stages, and FIGS. 8 and 9 illustrate various intermediate stages in the operation of another embodiment of the double backing-roller winder.

A double backing-roller winder has a conventional frame 1 with one columnar wall 2 on the right and another on the left that are connected by a bridge-like structure or rest against each other. Only one wall 2 has for simplicity's sake been illustrated. Mounted stationary between the two walls 2 are two backing rollers 3 and 4 that are powered in the directions indicated by the arrows. Walls 2 are provided with vertical guides 5 that vertically guide both claws 6 that accommodate a core tube 7 and a tensioning roller 8. Core tube 7 is comprised of a rod 9 and of a sleeve 10. The sleeve is conventionally secured to and can be removed from the rod. These details are for simplicity's sake illustrated very schematically. It will be evident that rod 9 is not directly mounted in core-tube accommodating claws 6 but that additional mounting elements are involved. The material 11 that is to be wound is continuously, uninterruptedly and at a constant rate, that is, supplied in the form of a web in the direction indicated by arrow 12. Material 11 is to be wound into a reel 13 on core tube 7 or sleeve 10. Reel 13 rests for this purpose on a bed 14 created by two backing rollers 3 and 4 and accordingly on two points, and is rotated by the backing rollers. Backing roller 4 can rotate somewhat more rapidly than backing roller 3 in order to generate tension on material 11. While the material is being wound in this position, tensioning roller 8, which can be moved up and down in the direction indicated by arrow 15, has been resting from the very beginning against reel 13. Tensioning roller 8 is for simplicity's sake illustrated in its upper position, lifted, that is, from the circumference of reel 13. Outriggers 16 that support a knife-like cutting mechanism 17 extending across the web of material 11 are attached to the bearing for tensioning roller 8. Frame 1 also includes an intermediate station 18 and a track 19. Intermediate station 18 is intended to accommodate a fresh core tube during reel replacement and is positioned at a high enough level to allow a partly wound reel 13 to be shifted beneath it. Track 19 terminates at accommodating-claw guides 5. Associated with guides 5 are sliding snap-in bolts 33 that are intended to intercept and release the unit comprised of core tube 7 and tensioning roller 8 and are powered by hydraulic cylinders 34. The double backing-roller winder is accordingly provided with its essential components.

Downstream of the double backing-roller winder is a Pope winder 20 with a supporting roller 21 that is, like backing rollers 3 and 4, mounted stationary but rotating on frame 1. The diameter of supporting roller 21 is essentially longer than those of backing rollers 3 and 4. Rollers 3, 4, and 21 are positioned in such a way that they rest tangentially from below against a joint horizontal plane. The axes of these three rollers are on the other hand close enough together to leave between them only the nips necessary to allow them to rotate. This measure makes it possible to employ core tubes with a comparatively small diameter. Supporting roller 21 is rotated in the direction indicated by arrow 22. Another essential element of Pope winder 20 is a mechanism 23 that pivots around an axis 24 that is simultaneously the axis of supporting roller 21. The frame that contains pivoting mechanism 23 also includes two arms 25, one on the right and one on the left of frame 1. A core-tube accommodating component 26 slides back and forth on each arm 25 in the direction indicated by double-headed arrow 27. A piston-and-cylinder mechanism 28 is mounted on each arm 25 to control the motion of core-tube accommodating components 26 in relation to the arms. Components 26 are, like core-tube accommodating claws 6, designed to accommodate a core tube 7 or rod 9. The intermediate bearings, clasps, etc. are again for simplicity's sake not illustrated. Core-tube accommodating components 26 pivot around axis 24 on arms 25 and specifically in the two directions indicated by double-headed arrow 29.

A mechanism 30 for intercepting and removing finished reels 13 has accommodating structures 31 that can be raised and lowered in the direction indicated by double-headed arrow 32. Finished-reel interception and removal mechanism 30 can be a traveling carriage or similar mechanism. It intercepts the finished reels and removes them.

The various stages of the method in accordance with the invention will now be specified with reference to FIGS. 2 through 7, which are highly schematic to make the various stages more understandable. Web-liked material 11 is continuously supplied and arrives over unillustrated pulleys at backing rollers 3 and 4, where it is wound on the sleeve 10 of core tube 7 into a reel 13. The diameter of reel 13 is allowed to increase to half of the prescribed final diameter for example. During this phase of the winding procedure, tensioning roller 8 forces reel 13 against backing rollers 3 and 4, a process that is especially necessary at the beginning of the procedure. A fresh core tube 7, consisting of a rod 9 and of a sleeve 10, is prepared for insertion by providing a line along the surface of sleeve 10 with a strip of adhesive and inserted into the core-tube accommodating components 26 of pivoting mechanism 23. The mechanism 23 in Pope winder 20 functions at this point as a mechanism for transferring the core tube.

Figure 3:
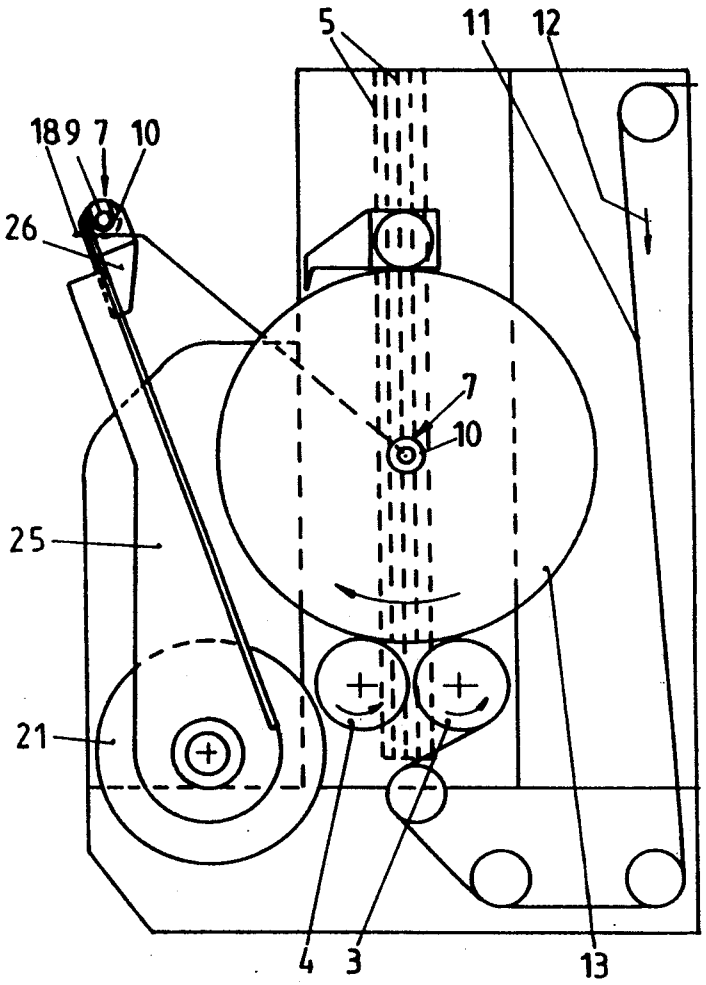
Figure 5:
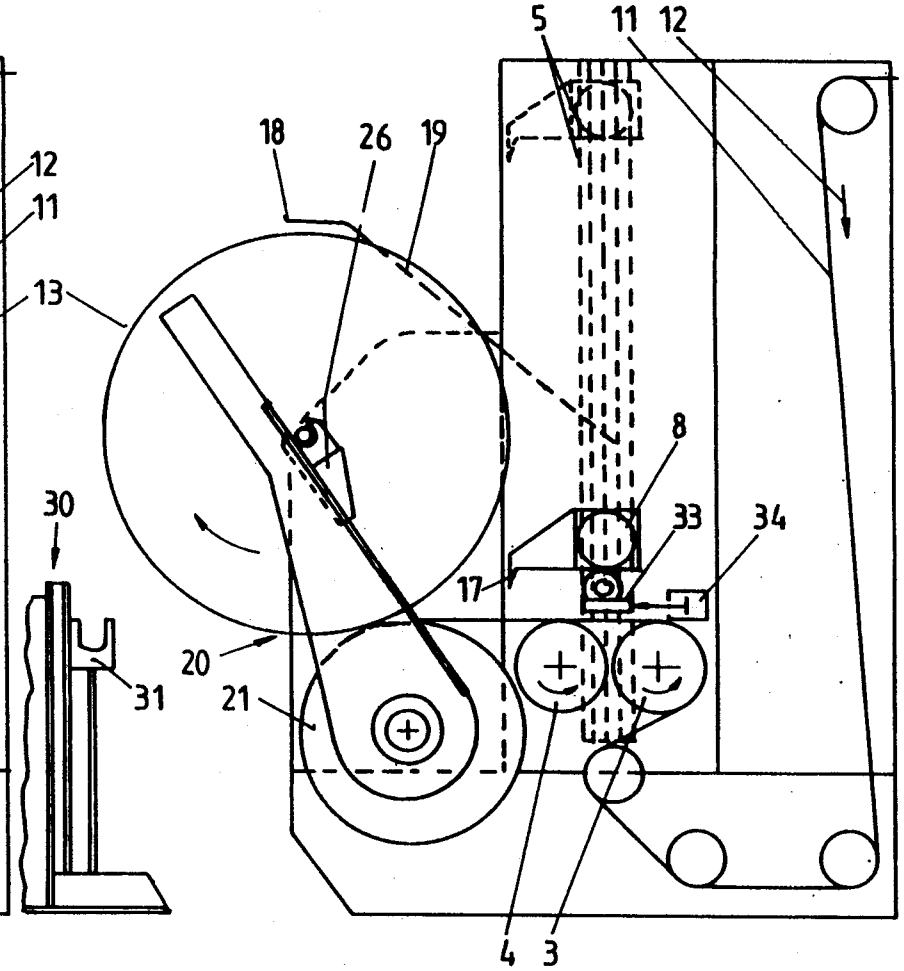
Figure 4:
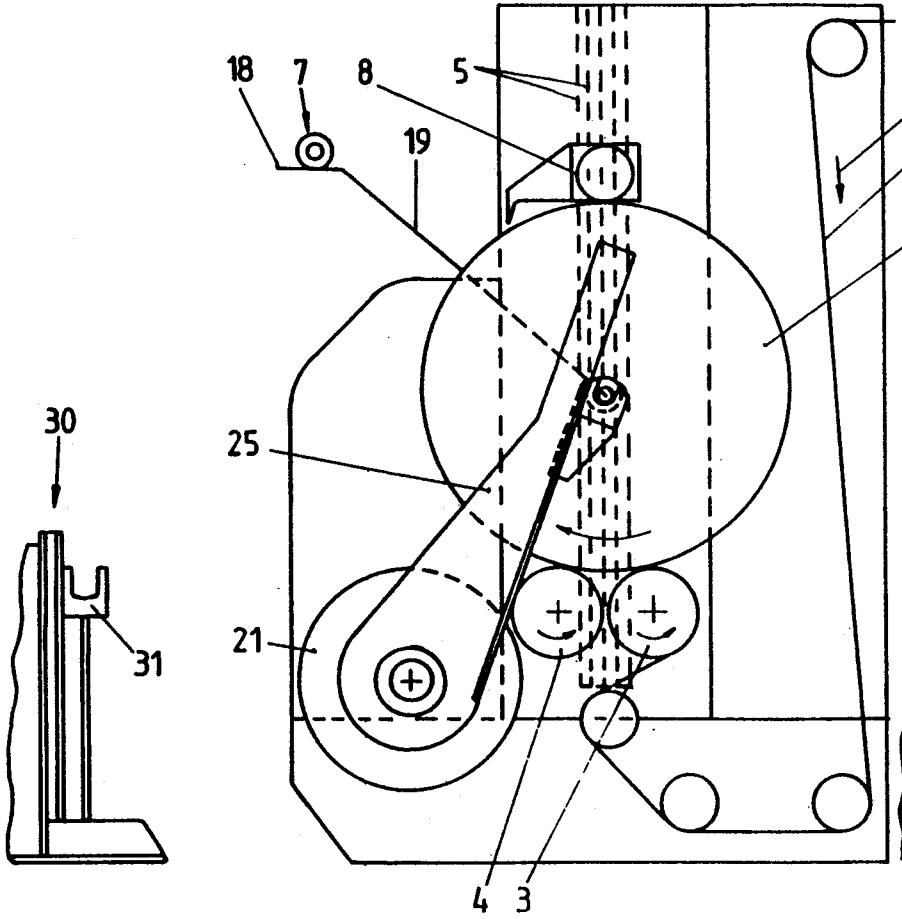

As will be evident from FIG. 3, pivoting mechanism 23 is pivoted clockwise and core-tube accommodating components 26 retracted to deposit fresh core tube 7 in intermediate station 18. Core-tube accommodating components 26 are then radially advanced along arms 25 and below the rod 9 of reel 13 (FIG. 4), intercepting the rod or tube and, as the winding process proceeds, shifting it over second backing roller 4 until it comes to rest against supporting roller 21. Tensioning roller 8 must of course be lifted before reel 13 can be intercepted. The roller can for example be shifted into the upper limiting position illustrated in FIG. 1. Arms 25 continue to pivot counterclockwise, whereby reel 13 arrives below intermediate station 18, until the tube comes to rest above supporting roller 21 as illustrated in FIG. 5. The winding procedure continues while the reel is being transferred in that the web of material 11 is of course still being supplied. Once reel 13 has just been intercepted by Pope winder 20 as illustrated in FIG. 5, fresh core tube 7 is transferred down out of intermediate station 18 and along track 19 until it arrives between core-tube accommodating claws 6. This action will occur automatically once core tube 7 has been released, when it will slide down along track 19. Tensioning roller 8 is then contacted with the sleeve 10 of a new and as yet unwound core tube 7. The unit comprised of core tube 7 and tensioning roller 8 is then deposited on the snap-in bolts 33 that can be retracted by hydraulic cylinder 34 but without coming into contact with material 11 (FIG. 5). At this point the winding procedure continues with the Pope winder alone until reel 13 attains its final diameter. The winding procedure can be broken down into a stage in the double backing-roller winder and another stage in the Pope winder in accordance with the particular situation. It is for example possible to wind approximately 50 to 70% of the reel in the double backing-roller winder and the remainder in the Pope winder.

Figure 6:
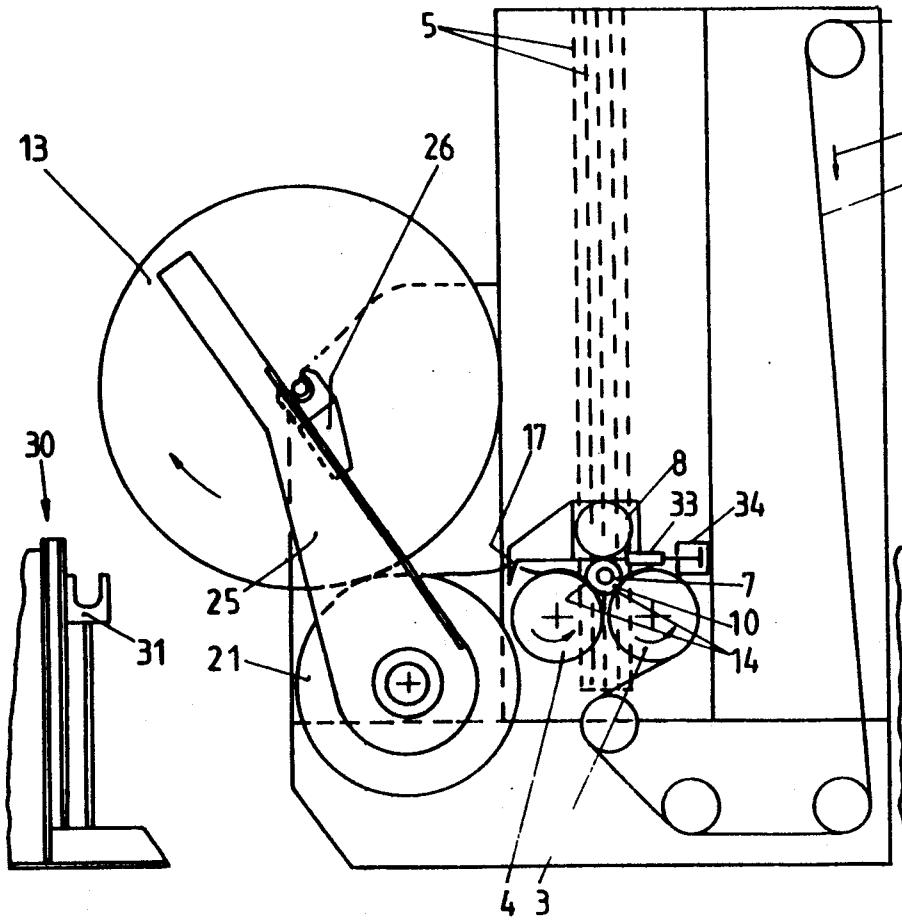

Once reel 13 has attained its prescribed final diameter, the unit comprised of fresh core tube 7 and tensioning roller 8 is separated as illustrated in FIG. 6 by cutting mechanism 17 by activating hydraulic cylinders 34 and hence snap-in bolts 33, allowing it to drop out. It is also possible to apply force with pistons at this stage. All that is important is for cutting mechanism 17 to separate the web of material 11 between second backing roller 4 and supporting roller 21 and for the adhesive strip on sleeve 10 to intercept the accordingly created new material beginning and wind it onto a fresh core tube 7 or sleeve 10, accordingly utilizing the bed 14 in the double backing-roller winder for a fresh core tube. An unillustrated rubber roller that acts on backing roller 3 from the right and secures the new initial strip of material can ensure maintenance of web tension immediately subsequent to separation.

Figure 2:
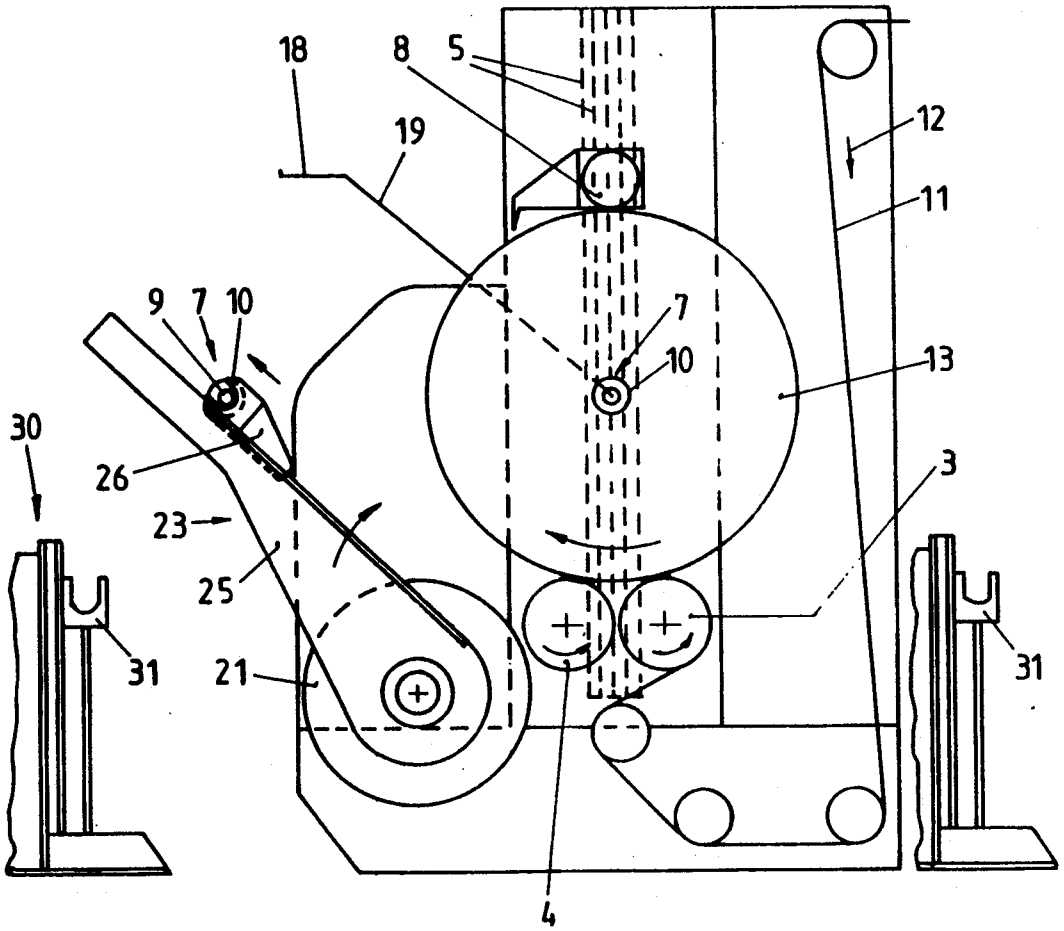

The diameter of the reel 13 on backing rollers 3 and 4 is even longer in FIG. 7, whereas the previously wound reel 13 has been transported by the core-tube accommodating components 26 on arms 25 as they pivot counterclockwise into finished-reel interception and removal mechanism 30 or its accommodating structures. Obviously, core-tube accommodating components 26 must be retracted to some extent for this purpose, so that reel 13 will lose contact with supporting roller 21 as illustrated in FIG. 7. A new core tube 7 is then inserted as illustrated in FIG. 2.

The embodiment of a double backing-roller winder illustrated in FIGS. 8 and 9 is in itself similar to the embodiment illustrated in FIGS. 1 through 7 except that intermediate station 18 is no longer stationary but located on the same beam as cutting mechanism 17. The result is an assembly comprised of tensioning roller 8, cutting mechanism 17, and intermediate station 18 that can be raised and lowered as a single unit. The beam that tensioning roller 8 is mounted on contains for this purpose two arms 35 that pivot around the axis of tensioning roller 8 with bearing recesses 36 at their free ends. A drive mechanism 37, in the form of an electric motor with a cogwheel transmission for example, rotates arms 35, the limiting positions of which are illustrated in FIGS. 8 and 9.

Once a completely wound reel 13 has been intercepted by the pivoting mechanism 23 in Pope winder 20 and transferred into the accommodating elements 31 in interception and removal mechanism 30 and removed, a fresh core tube 7 comprised of rod 9 and sleeve 10 is inserted into the core-tube accommodating components 26 of arms 25. The arms are pivoted into the position illustrated in FIG. 8, where core tube 7 is precisely above the bearing recesses 36 in arms 35. As the diameter of pivoting mechanism 23 increases during the phase of the winding procedure that occurs in double backing-roller winder, tensioning roller 8 will lift its beam along with the arms 35 in intermediate station 18, forcing core tube 7 out of bearing recesses 36. Obviously, since both core-tube accommodating components 26 and bearing recesses 36 are secured by hydraulic clasps, core tube 7 will be secured in each position. These elements are for simplicity's sake not illustrated. Once core tube 7 is resting in bearing recesses 36 and secured therein, pivoting mechanism 23 will be free again and can transfer reel 13 out of the double backing-roller winder as specified in relation to the phase illustrated in FIG. 4 with respect to the first embodiment. It will be obvious that the assembly comprised of tensioning roller 8 and intermediate station 18 must be lifted a little farther before and during the transfer procedure to release tensioning roller 8 from reel 13. Reel 13 is then transferred into the intermediate position illustrated in FIG. 9, so that Pope winder 20 can carry out the rest of the winding procedure on that assembly. This is followed by the descent of the assembly into more or less the position illustrated in FIG. 9, whereby drive mechanism 37 is simultaneously or subsequently activated, pivoting arms 35 and core tube 7 onto snap-in bolts 33. Obviously, rod 9, which was previously tensioned into bearing recesses 36, is simultaneously released. Arms 35 are then pivoted clockwise a little farther as illustrated in FIG. 9 so that the assembly comprised of tensioning roller 8 and arms 35 can be lifted again, whereby arms 35 are pivoted back into the position illustrated in FIG. 8 until cutting mechanism 17 finally constitutes the bottommost point of the assembly. The assembly is then lowered again until tensioning roller 8 rests against sleeve 10. Hydraulic cylinders 34 are then activated again to replace the reel and separate material 11, whereby cutting mechanism 17 separates the material once the reel has attained its prescribed diameter in the Pope winder and a fresh core tube 7 begins a new winding procedure in double backing-roller winder. The rest of the operation is similar to the operation specified with reference to FIGS. 1 through 7. It should however be pointed out that the transfer of the fresh core tube out of the core-tube accommodating components 26 and into the bearing recesses 36 can be accomplished not only in accordance with the increasing diameter of the reel in double backing-roller winder but also when the reel attains a size and weight that eliminates the need for applying tensioning roller 8. The assembly comprised of tensioning roller 8, intermediate station 18, and cutting mechanism 18 has several functions. It applies pressure through tensioning roller 8 and maintains constant tension in the preliminary-winding unit. It serves as a mount for cutting mechanism 17, for which it provides the necessary motion. Finally, it accommodates intermediate station 18 and constitutes part of the mechanism that transfers the core tube from the intermediate station to snap-in bolts 33.

A fresh core tube may be prepared for winding once the reel has been accepted by the Pope winder. The previously wound reel may be lowered into the bed formed by the backing rollers when the previously wound reel has attained the final diameter. The web of wound material on the previously wound reel is then simultaneously passed between one of the backing rollers and the supporting roller.

We claim:

1. A double backing-roller winder for winding continuously supplied material onto a plurality of core tubes, comprising: two powered backing rollers forming a bed for each of a plurality of reels; said reel having a core tube and material wound thereon; a tensioning roller extending vertically over the bed; means for supplying said core tubes to said bed; means for removing said reels from said bed; means for cutting off the material being wound; a Pope winder located downstream of said two backing rollers with a supporting roller and pivoting means; said supporting roller having a longer diameter than said backing rollers and having an axis; said pivoting means pivoting about said axis of said supporting roller; said pivoting means having two arms with sliding elements mounted thereon for accommodating a core tube; means for intercepting and removing finished reels, said pivoting means pivoting with said core tube and accommodating element either into a space above said backing rollers or beyond a winding position in said Pope winder as far as said means for intercepting and removing finished reels.

2. A method of winding continuously supplied material without interruption onto several core tubes, particularly on printing presses, with a double backing-roller winder having two backing rollers and a bed, comprising the steps: winding material into a reel without a tension roller rests on said reel by winding the material initially on a core tube resting against said two backing rollers in said double backing-roller winder until the reel is heavy enough to weigh down against a supporting roller in a Pope winder; said backing rollers and said supporting roller having fixed axes of rotation that can be closely spaced from each other; lifting said reel off the bed of said double backing-roller winder by pivoting means; moving said reel over one of said two backing rollers and in a position against said supporting roller in said Pope winder, said step of moving said reel being carried out through a predetermined path having a substantially short length dependent on the relative close spacing of said backing rollers and said supporting roller; winding said reel thereafter in said position until said reel attains a predetermined final diameter; and providing cutting means for cutting said web at an upper level of said web; preparing a fresh core tube for winding once the reel has been accepted by said Pope winder; lowering the previously wound reel into said bed formed by said backing rollers when said previously wound reel has attained said predetermined final diameter, and simultaneously passing the web of wound material between said one of said backing rollers and said supporting roller; removing a finished reel with said pivoting means in said Pope winder; lifting a fresh core tube into an intermediate station in said double backing-roller winder with said pivoting means; and lifting a partly wound reel on said backing rollers onto said supporting roller with said pivoting means, said web of material that is wound being separable during motion of said web from a high level to a low level.

3. A method of winding continuously supplied material without interruption onto several core tubes, particularly on printing presses, with a double backing-roller winder having two backing rollers and a bed, comprising the steps: winding material into a reel during a first winding stage while a tensioning roller rests on said reel by winding the material initially on a core tube resting against said two backing rollers in said double backing-roller winder until the reel is heavy enough to weigh down against a supporting roller in a Pope winder; said backing rollers and said supporting roller having fixed axes of rotation that can be closely spaced from each other; lifting said reel off the bed of said double backing-roller winder by pivoting means; moving said reel over one of said two backing rollers and in a position against said supporting roller in said Pope winder, said step of moving said reel being carried out through a predetermined path having a substantially short length dependent on the relative close spacing of said backing rollers and said supporting roller; continuing winding said reel thereafter in said position during a second winding stage until said reel attains a predetermined final diameter; and cutting said web at an upper level of said web as said web moves from an upper level to a lower level, said upper level being above said lower level.

4. A method as defined in claim 3, including the steps of: removing a finished reel with said pivoting means in said Pope winder; lifting a fresh core tube into an intermediate station in said double backing-roller winder with said pivoting means; and lifting a partly wound reel on said backing rollers onto said supporting roller with said pivoting means.

5. A method as defined in claim 3, including the steps of: preparing a fresh core tube for winding once the reel has been accepted by said Pope winder; lowering the previously wound reel into said bed formed by said backing rollers when said previously wound reel has attained said predetermined final diameter, and simultaneously passing the web of wound material on said previously wound reel between said one of said backing rollers and said supporting roller.

6. A method as defined in claim 5, wherein said web of material being wound is separated during motion of said web from said upper level to said lower level.

7. A double-backing roller winder for winding continuously supplied material onto a plurality of core tubes, comprising: two powered backing rollers forming a bed for each of a plurality of reels; said reel having a core tube and material wound thereon each reel being partially wound during a first winding stage; a tensioning roller extending horizontally over the bed; means for supplying fresh ones of said core tubes to said bed; pivoting means for removing said partially wound ones of said reels from said bed after said first winding stage; means for cutting off the material being wound; a Pope winder located downstream of said two backing rollers and having supporting roller and said pivoting means for receiving said partially wound reels from said bed and finish winding said partially wound reels in a second winding phase; said supporting roller having a longer diameter than said backing rollers and having an axis; said pivoting means pivoting about said axis of said supporting roller.

8. A double backing-roller winder as defined in claim 7, including axially stationary bearings above said backing rollers for mounting said core tube.

9. A double backing-roller winder as defined in claim 7, including axially stationary bearings above said backing rollers and in vicinity of said Pope winder for mounting said core tube.

10. A double backing-roller winder as defined in claim 7, including vertical guides for claws accommodating a core tube and for bearings mounting said tensioning roller; said vertical guides being located in a space above said backing rollers; said cutting means being attached to said bearings mounting said tensioning roller between said one of said backing rollers and said supporting roller.

11. A double backing-roller winder as defined in claim 7, wherein said pivoting means comprises two arms with sliding elements mounted thereon to accommodate said core tube; means for intercepting and removing finished reels, said pivoting means pivoting along with said core tube and accommodating elements into a space above said backing rollers and beyond a winding position in said Pope winder as far as said means for intercepting and removing finished reels.

12. A double backing-roller winder as defined in claim 7, wherein said pivoting means in said Pope winder comprises said means for supplying fresh ones of said core tubes and said means for removing finished ones of said reels.

13. A double backing-roller winder as defined in claim 12, including an intermediate station for said pivoting means to receive ready-to-wind core tubes, said ready-to-wind core tubes arriving into said bed from said intermediate station.

14. A double backing-roller winder as defined in claim 13, wherein said intermediate station, said tensioning roller, and said cutting means comprise a single assembly; and further comprising means for moving said single assembly.

15. A double backing-roller winder as defined in claim 14, wherein said intermediate station has arms with bearing recesses for accommodating core-tube rods, and drive means for pivoting said arms.

* * * * *